US005979674A

United States Patent [19]

Thalenfeld

[11] Patent Number: 5,979,674

[45] Date of Patent: Nov. 9, 1999

[54] ADAPTER WITH CROSS BAR FOR MOUNTING PIVOTING LABEL HOLDERS

[75] Inventor: David R. Thalenfeld, Bear Creek, Pa.

[73] Assignee: Trion Industries, Inc., Wilkes-Barre, Pa.

[21] Appl. No.: 08/967,425

[22] Filed: Nov. 10, 1997

[51] Int. Cl.[6] ..... B42F 7/00

[52] U.S. Cl. ..... 211/57.1; 248/220.22; 40/642.01

[58] Field of Search ..... 248/220.22, 220.21, 248/220.41, 220.31, 222.2, 307, 309.1, 222.42; 40/642.01, 647; 211/57.1, 59.1, 54.1; 403/233, 238

[56] References Cited

U.S. PATENT DOCUMENTS

| | | | |
|---|---|---|---|
| 4,246,710 | 1/1981 | Mixer | 40/16.4 |
| 4,351,440 | 9/1982 | Thalenfeld | 211/57.1 |
| 4,593,824 | 6/1986 | Pfeifer | 211/57.1 |
| 4,801,116 | 1/1989 | Blankenship | 248/220.4 |
| 4,850,557 | 7/1989 | Valiulis | 248/220.4 |
| 5,236,163 | 8/1993 | Valiulis | 248/220.4 |
| 5,348,167 | 9/1994 | Jensen | 211/57.1 |
| 5,441,161 | 8/1995 | Meri | 211/57.1 |
| 5,442,872 | 8/1995 | Moser | 40/642 |
| 5,645,175 | 7/1997 | Wood | 211/57.1 |
| 5,678,794 | 10/1997 | Kump | 248/220.31 |
| 5,702,008 | 12/1997 | Thalenfeld et al. | 211/57.1 |
| 5,815,970 | 10/1998 | Thalenfeld | 40/642.01 |
| 5,826,359 | 10/1998 | Thalenfeld | 40/642.01 |
| 5,860,239 | 1/1999 | Thalenfeld | 40/642.01 |
| 5,887,731 | 3/1999 | Thalenfeld | 211/57.1 |

*Primary Examiner*—Ramon O. Ramirez
*Assistant Examiner*—Tan Le
*Attorney, Agent, or Firm*—Schweitzer Cornman Gross & Bondell LLP

[57] ABSTRACT

An adapter device for mounting a pivoting label holder on a merchandise display hook originally designed for fixed label holders and having a label support arm formed with a laterally extending label support portion at the outer end thereof. The adapter device includes a plastic body for mounting on the shaft of the merchandise display hook and has a cross bar aligned perpendicular to the label support arm, for the support of a pivoting label holder. The cross bar can comprise a cross bar portion extending laterally from the adapter body in a direction opposite to and coaxial with the laterally extending label support portion of the label support arm, thereby forming a combined support for the pivoting label holder. A forwardly-open stabilizing element engages the label support portion to prevent the adapter from pivoting about the shaft. Alternatively, the adapter device can include an integral full-width cross bar for mounting the pivoting label holder, with elements for stabilizing and positively locating the adapter.

16 Claims, 9 Drawing Sheets

FIG. 4
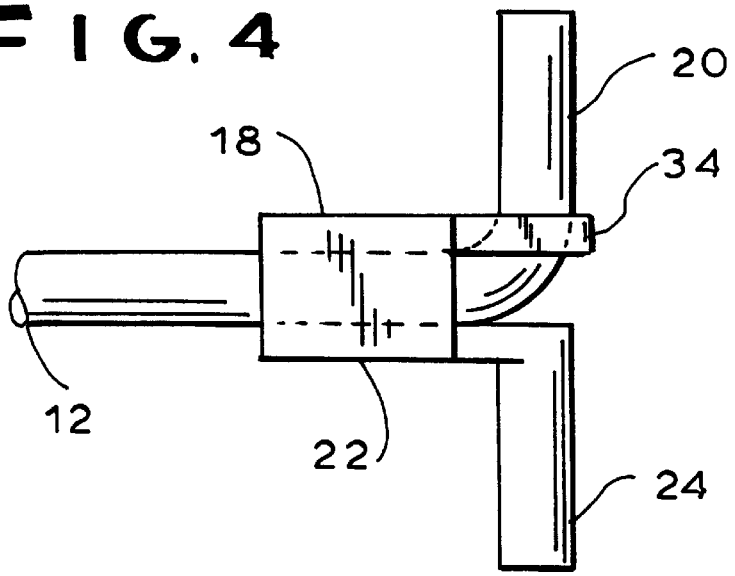
FIG. 5
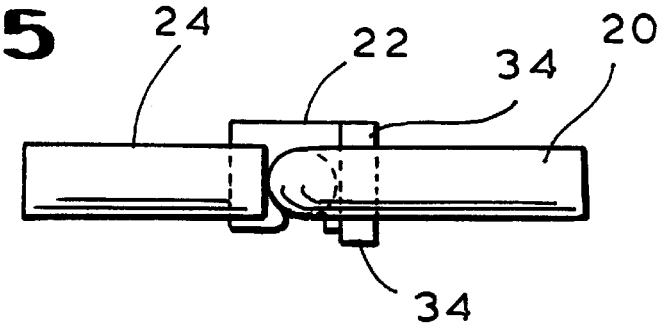
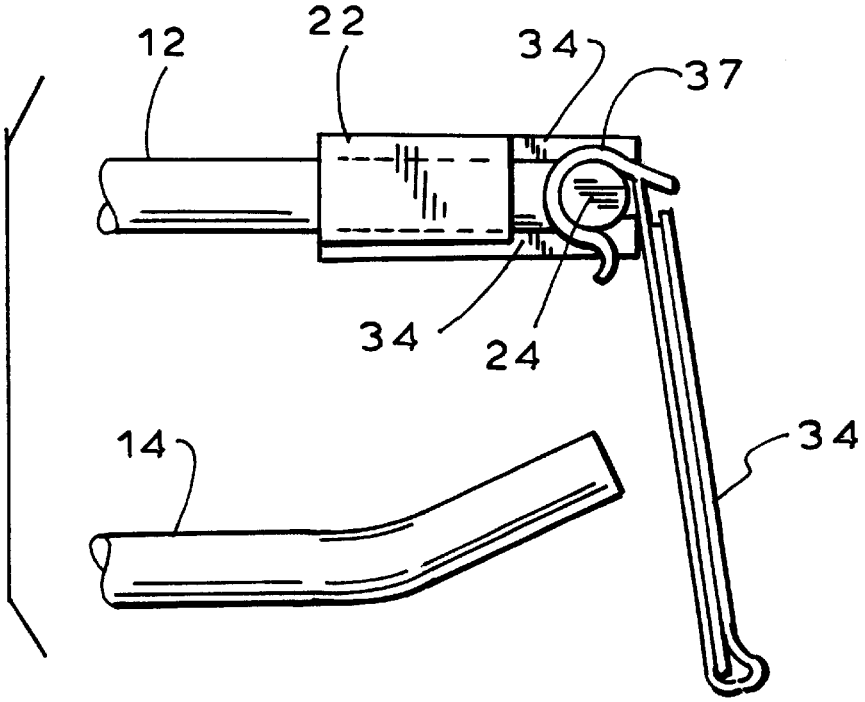
FIG. 6

FIG. 9
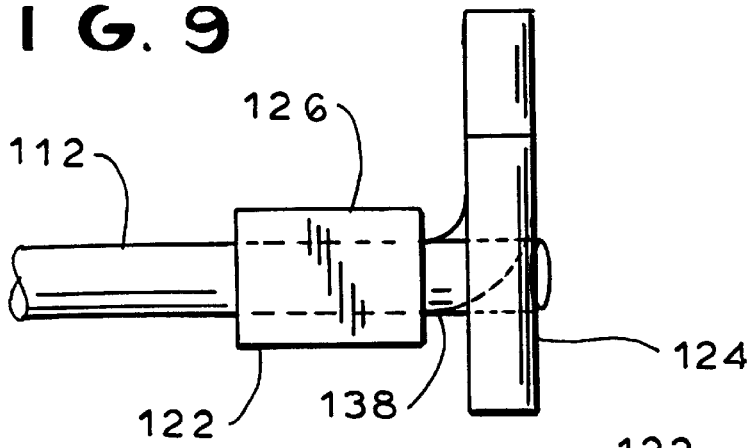
FIG. 10
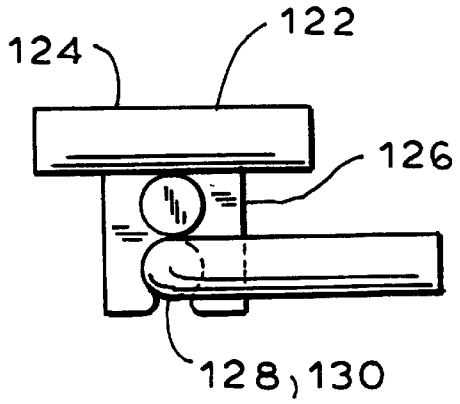
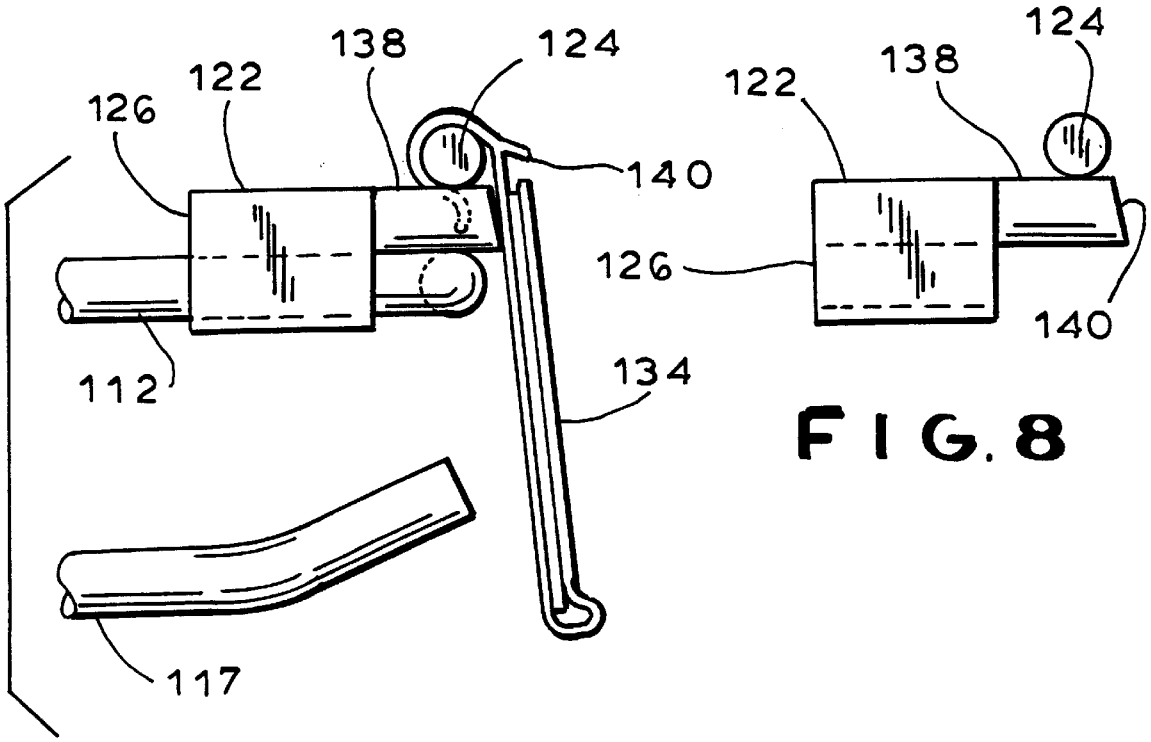
FIG. 8
FIG. 7

ADAPTER WITH CROSS BAR FOR MOUNTING PIVOTING LABEL HOLDERS

FIELD OF THE INVENTION

This invention relates to the field of merchandise display hooks, and in particular to merchandise display hooks with pivoting label holders.

BACKGROUND AND SUMMARY OF THE INVENTION

Merchandise display hooks typically have a merchandise support arm and often have a label support arm extending forwardly above the merchandise support arm for supporting price and item information, and the like. The information can be displayed on a label holder which is fixed to the outer end of the label support arm, or the label holder can be pivotally attached to the end of the label holder support arm. For pivotal mounting of the label holder the support can be provided with a cross bar which extends laterally on either side of the shaft of the label support arm and provides the desired pivotal support.

Pivoting label holders typically include one or more rearwardly-extending retaining clip portions, which can be cylindrical in shape, and which are configured to be loosely pivotally mounted on the cross bar. The pivoting label holders are typically formed by extrusion of suitable plastic material and include a notch in the retaining clip portion to accommodate the shaft of the label support arm. Thus, the retaining clip portion attaches to the cross bar on either side of the shaft of the label support arm, and the opening or gap between the retaining clip portions allows the pivoting label holder to pivot upward during stocking and removal of product from the merchandise support arm located below the label support arm.

The above described merchandise display hooks, with pivoting label holders, are becoming more widely used and are increasingly desired by mass merchandisers. However, there are many millions of display hooks of various types currently in use which are not designed for attachment of a pivoting label holder. An objective of this invention is to provide a cost-effective means to adapt one of the existing styles of merchandise display hooks, originally designed for mounting of fixed label holders, for use with pivoting label holders. Store owners are thus able to install pivoting label holders by conversion of existing, installed devices, without requiring the expense of complete replacement.

The present invention more particularly comprises an adaptor device designed to be attached to the outer end of the label support arm of a merchandise display hook originally designed for fixed label holders, modifying the device for mounting of a pivoting label holder. The adaptor device of the invention is designed for mounting on a label support arm which is substantially L-shaped, having a generally straight, outwardly extending shaft and a laterally extending label support portion aligned substantially perpendicular to the shaft. The adaptor device mounts on the outer end of the label support arm and includes means to form at least a portion of a cross bar extending laterally, perpendicular to the label support arm for mounting a standard pivoting label holder.

In one form of the invention, the cross bar-forming means of the adaptor device comprises a cross bar portion extending laterally from the adaptor body in a direction generally opposite to the laterally extending label support portion of the label support arm. The cross bar portion is aligned to be substantially coaxial with the label support portion to form a combined support for the pivoting label holder on both sides of the shaft of the label support arm. The pivoting label holder thus rotatably attaches to both the cross bar portion of the adaptor device and to the label support portion of the label support arm. The adaptor device also includes means to engage the label support portion to lock the adaptor device in fixed position with respect to the label support arm.

In another embodiment of the invention, the adaptor includes a full-width cross bar element which extends on both sides of the label support arm. The pivoting label holder is thus pivotally mounted exclusively by the cross bar of the adapter device.

In a third embodiment of the invention, the adapter includes a stabilizing clip portion configured to engage the laterally extending label support portion when the adapter is mounted to the shaft such that the adapter is prevented from rotating with respect to the shaft, thus mounting the attached cross bar in a fixed horizontal orientation.

BRIEF DESCRIPTION OF THE DRAWINGS

FIG. 4 is an enlarged top plan view of the adapter device of the invention, shown mounted on the merchandise display hook of FIG. 1;

FIG. 5 is an enlarged side elevational view of the label support arm and adapter assembly of FIG. 2;

FIG. 6 is a front elevational view of the adapter device of FIG. 1;

FIG. 7 is an enlarged side elevational view of a second embodiment of the invention illustrating the adapter device and pivoting label holder mounted on a label support arm;

FIG. 8 is a side elevational view of the adapter of FIG. 7;

FIG. 9 is an enlarged top plan view of the adapter device and display hook assembly of FIG. 7;

FIG. 10 is a front elevational view of the adapter device of FIG. 7;

DETAILED DESCRIPTION OF THE INVENTION

Figure 1:
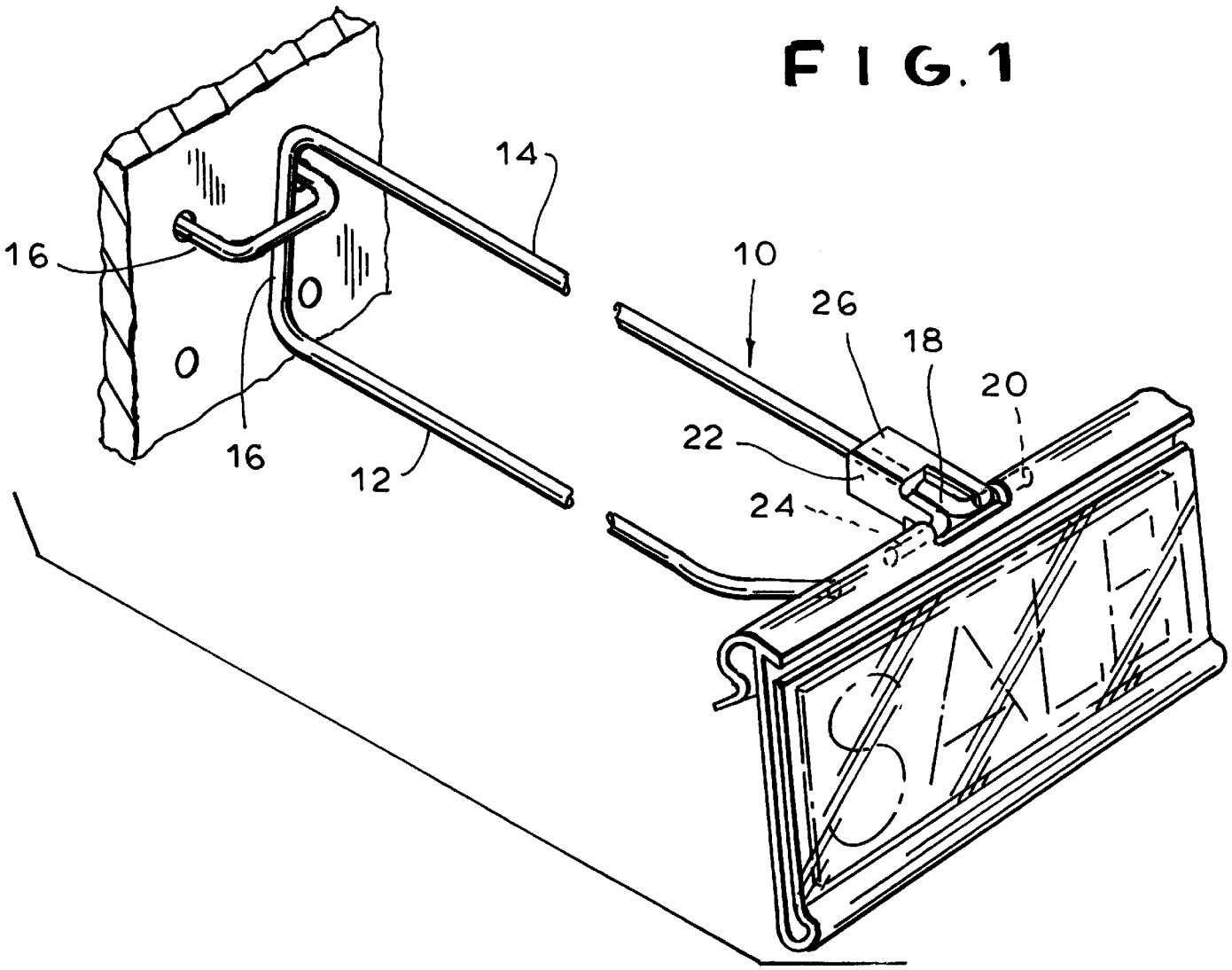
FIG. 1 is a perspective view of an assembly of a first embodiment of the adapter device of the present invention with a merchandise display hook of existing design.

Referring to FIGS. 1–6, the adapter device 22 of the present invention is designed to mount on a known merchandise display hook 10 which typically is formed of wire and includes a label support arm 14, a merchandise arm 12, and suitable mounting means, generally indicated at 16. The label support arm 14 has an outer end 18 and a laterally extending label support portion 20. The laterally extending label support portion 20 is disposed at right angles to the main label support arm 14 and, when the display hook is installed on an apertured panel or the like, is oriented horizontally. As originally designed and installed, the display hook is intended to be used with an extruded plastic label holder (not shown) having a generally flat front surface, for mounting of a label, and a partially closed channel extending for the full width of the label holder along its back surface. The partially closed channel is designed to be received snugly over the laterally extending arm portion 20, with central portions of the channel walls passing over the outwardly extending end portion 18, so that the label holder is more or less centered with respect to the label support arm 14. The channel walls are resiliently displaced outwardly, in the region of the outer end portion 18, and the displaced walls serve both to secure the label holder tightly in mounted position and to prevent any rotation or pivoting action of the label holder with respect to the laterally extending arm portion 20.

Figure 2:
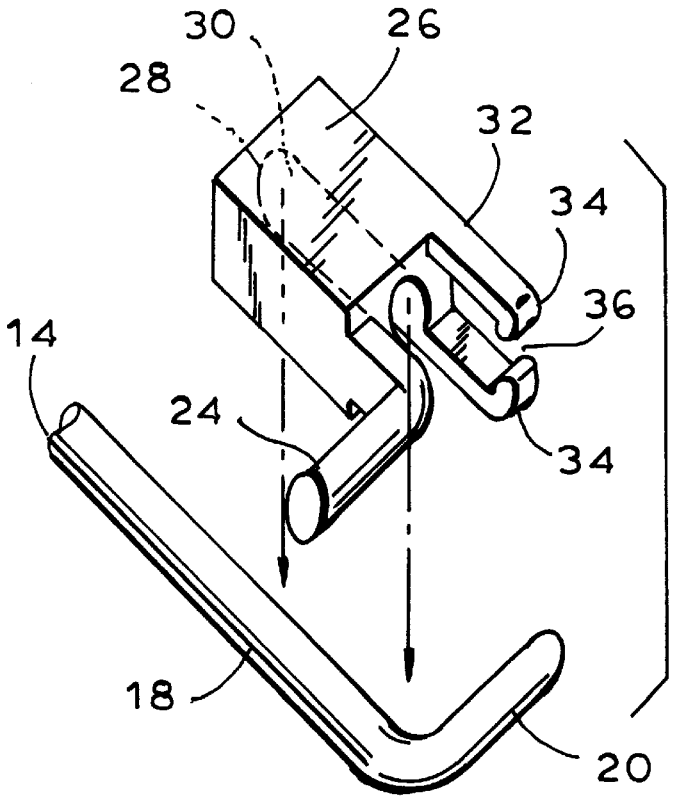
FIG. 2 is an exploded, perspective view of the adapter of FIG. 1 and the end of the merchandise display hook.
Figure 3:
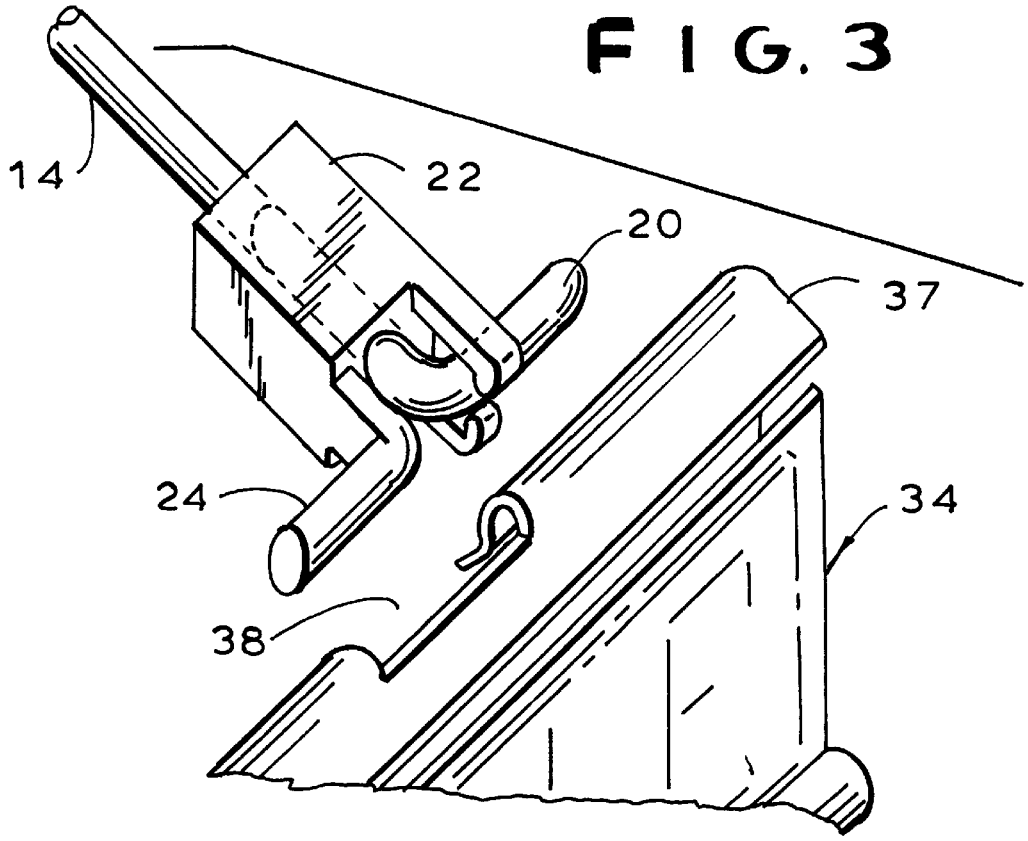
FIG. 3 is a perspective view of the adapter of FIG. 1 mounted on the merchandise display hook.

Pursuant to the present invention, the display hook 10 is converted for use with a pivoting label holder by removal of the original, fixed label holder and mounting of the new adapter device. The adapter device 22, which may be formed of injection molded plastic material, is mountable on the outer end 18 of the label support arm 14 and includes a cross bar element 24 extending laterally from the body 26 of the adapter 22. As best seen in FIG. 2, the adapter device 22 includes a groove 28 sized to accept the outer end 18 of the label support arm 14. The groove 28 includes a narrow entry gap 30, and the plastic material of which the adapter device is formed preferably is comprised of resiliently deformable material such that the adapter device 22 can be mounted on the label support arm 14 by urging the label support arm 14 through the narrow entry gap 30 and into the groove 28.

The adapter also includes an integral retaining clip 32 comprised of two opposed, spaced-apart gripping arms 34 which form a narrow entry gap 36 therebetween. The retaining clip 32 is adapted to partially surround the laterally extending label support portion 20 to stabilize the adapter device 22 and prevent its rotation relative to the label support arm 14. Thus, in mounting the adapter device 22, the groove 28 is first urged onto the label support arm 14, and in particular onto the outer end portion 18 thereof. Then, the adapter device is moved forward such that the gripping arms 34 of the retaining clip 32 are urged over and around the label support portion 20. When the adapter device 22 is properly installed, the cross bar element 24 of the adapter and the laterally extending label support portion 20 of the label support arm 14 are substantially coaxial, and together they form a cross bar extending on both sides of the label support arm 14.

While the above method for mounting the adapter device 22 is preferable, it can be appreciated that the adapter 22 can also be mounted by first engaging the retaining clip 32 with the label support portion 20 and then rotating the adapter 22 until the channel 28 engages the outer end portion 18 of the label support arm 14. In either case, when the adapter device 22 is properly mounted to the label support arm 14, the pivoting label holder 34, and in particular the retaining clip portions 37 thereof can be mounted onto the cross bar assembly formed by the cross bar element 24 and the label support portion 20 to mount the pivoting label holder 34. Preferably, the retaining clip portion 37 of the pivoting label holders 34 includes a gap 38 therein to accommodate the body structure 26 of the adapter device 22 and to allow the pivoting label holder to rotate upward.

Referring to FIGS. 7–10, illustrating another embodiment of the invention, the adapter device 122, advantageously formed of molded plastic material, includes an integral full-width cross bar element 124 which extends on both sides of the label support arm 114 when the adapter 122 is properly mounted. The pivoting label holder 134 therefore attaches directly to the cross bar element 124 of the adapter device 122. As best seen in FIG. 10, the adapter 122 includes a channel 128 adapted to tightly grip the label support arm 114. The channel 128 includes a resiliently deformable, narrow entry gap 130 to retain the adapter device 122 on the label support arm 114.

The cross bar element 124 is preferably mounted forward of the body 126 of the adapter device 122 on a forwardly extending support 138. The cross bar element 124 is preferably mounted on the top of the support 138, adjacent the front end face 140 thereof. As best seen in FIGS. 7 and 8, the cross bar element 124, support 138 and the end face 140 can be configured such that the end face 140 supports the pivoting label holder 134 at a slightly upwardly-tilted angular orientation to provide greater visibility to the information contained in the label holder.

Figure 11:
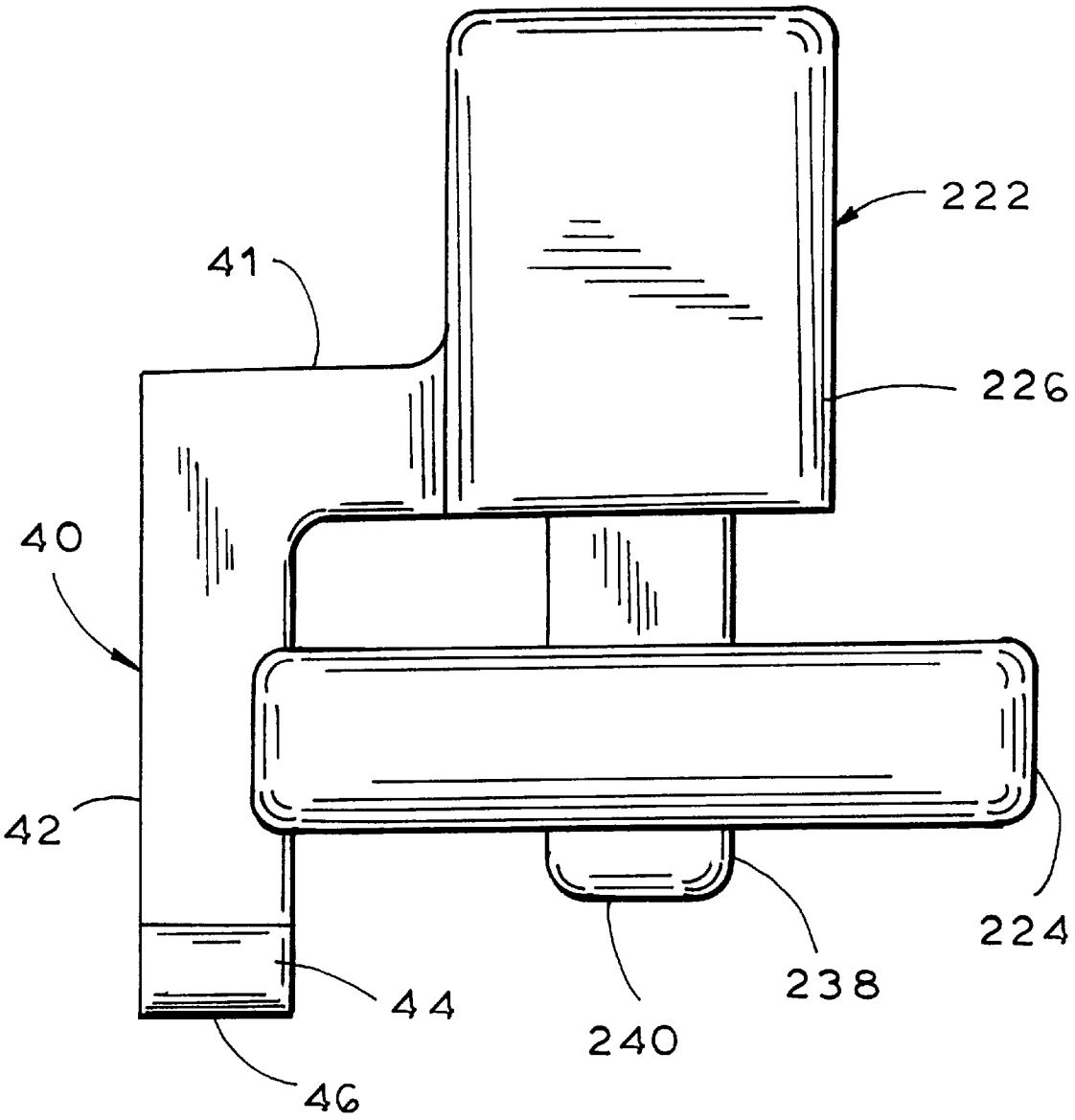
FIG. 11 is a top plan view of a third embodiment of the adapter.
Figure 12:
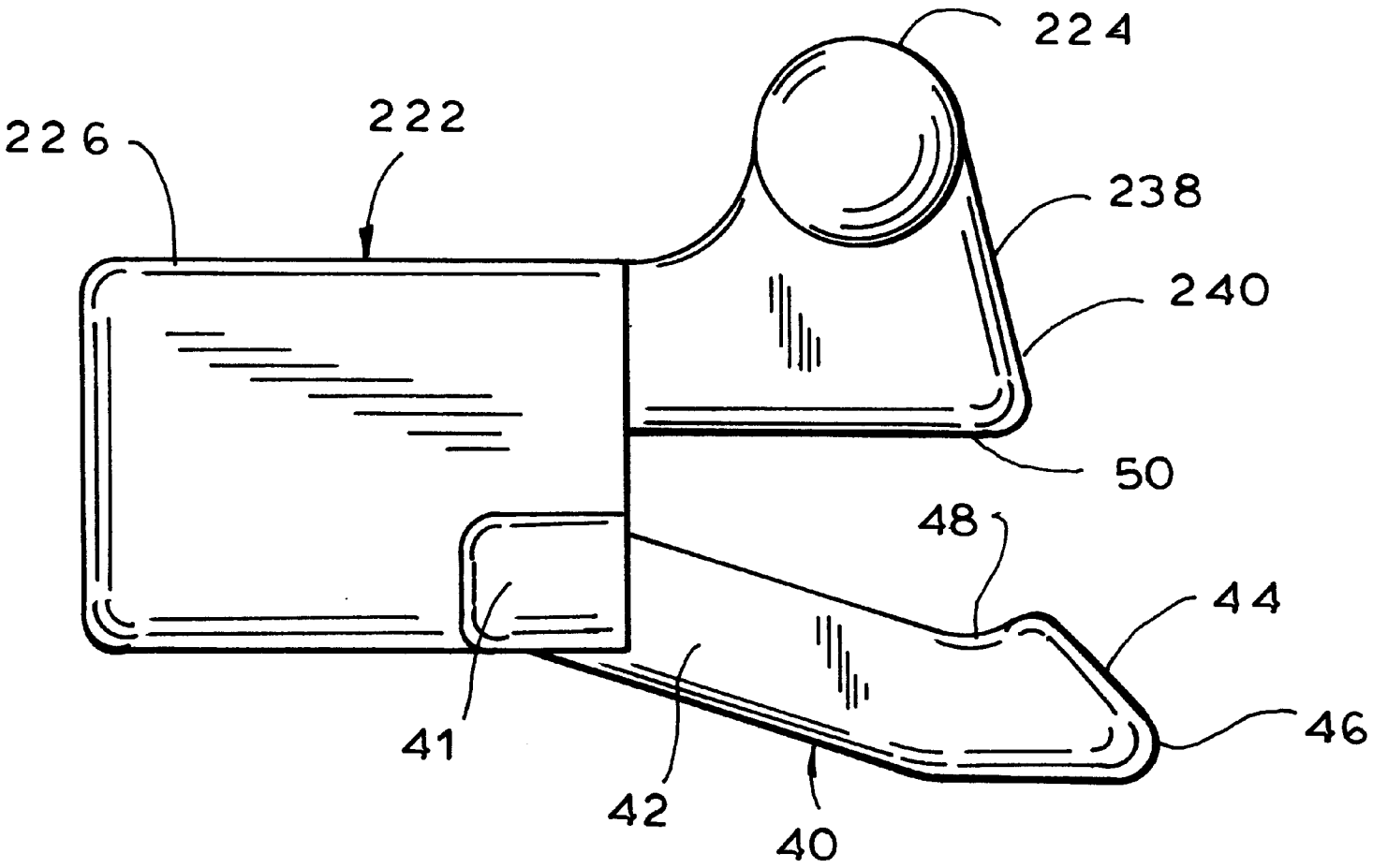
FIG. 12 is a side elevational view of the adapter of FIG. 11.
Figure 13:
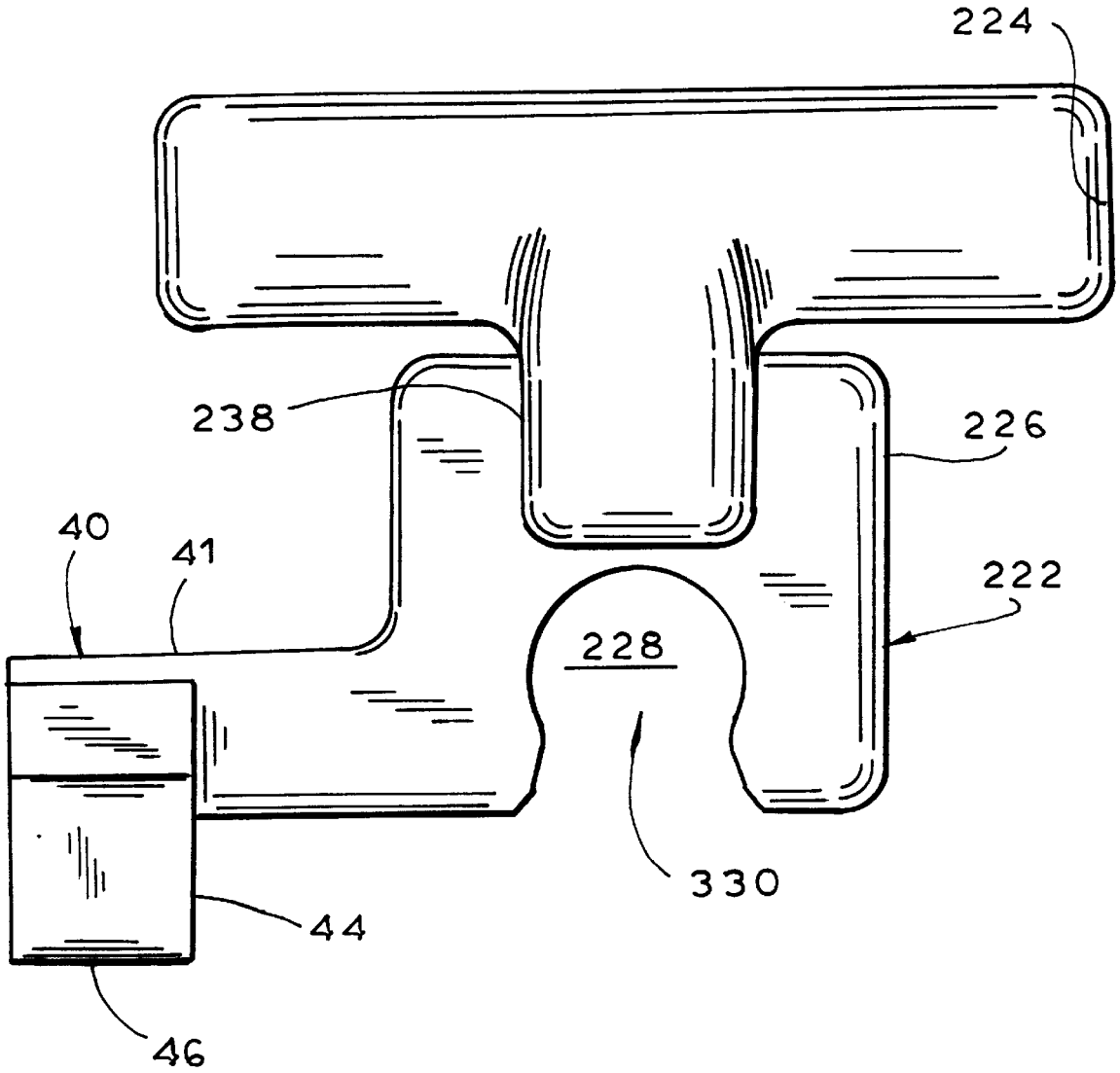
FIG. 13 is a front elevational view of the adapter of FIG. 11.

Referring to FIGS. 11–13, illustrating a third embodiment of the invention, the adapter device 222 is formed of resilient plastic material and includes a full-width cross bar element 224 which extends on both sides of the label support arm 214 when the adapter 222 is properly mounted. The adapter 222 includes a channel 228 configured to tightly grip the label support arm. Preferably, the channel 228 includes a resiliently deformable, narrow entry gap 230 to retain the adapter device 222 on the label support arm 214. The cross bar element 224 is preferably mounted forward of the adapter body 226, on the top of a forwardly extending support 238, adjacent the front end face 240 thereof.

Extending forwardly from the body 226 is a stabilizing element 40 adapted to engage the label support portion of the label holder arm (neither shown). The stabilizing element 40 includes a laterally extending first arm 41 connected to the adapter body 226 and a forwardly and preferably downwardly extending second arm 42. An inclined guide portion 44 is located on a free end 46 of the second arm 42 for guiding the element 40 underneath the label support portion 220 of the label holder arm during mounting. Inward from the free end 46 and guide portion 44 is a recess 48 (best seen in FIG. 12) adapted to engage the label support portion therein.

Figure 14:
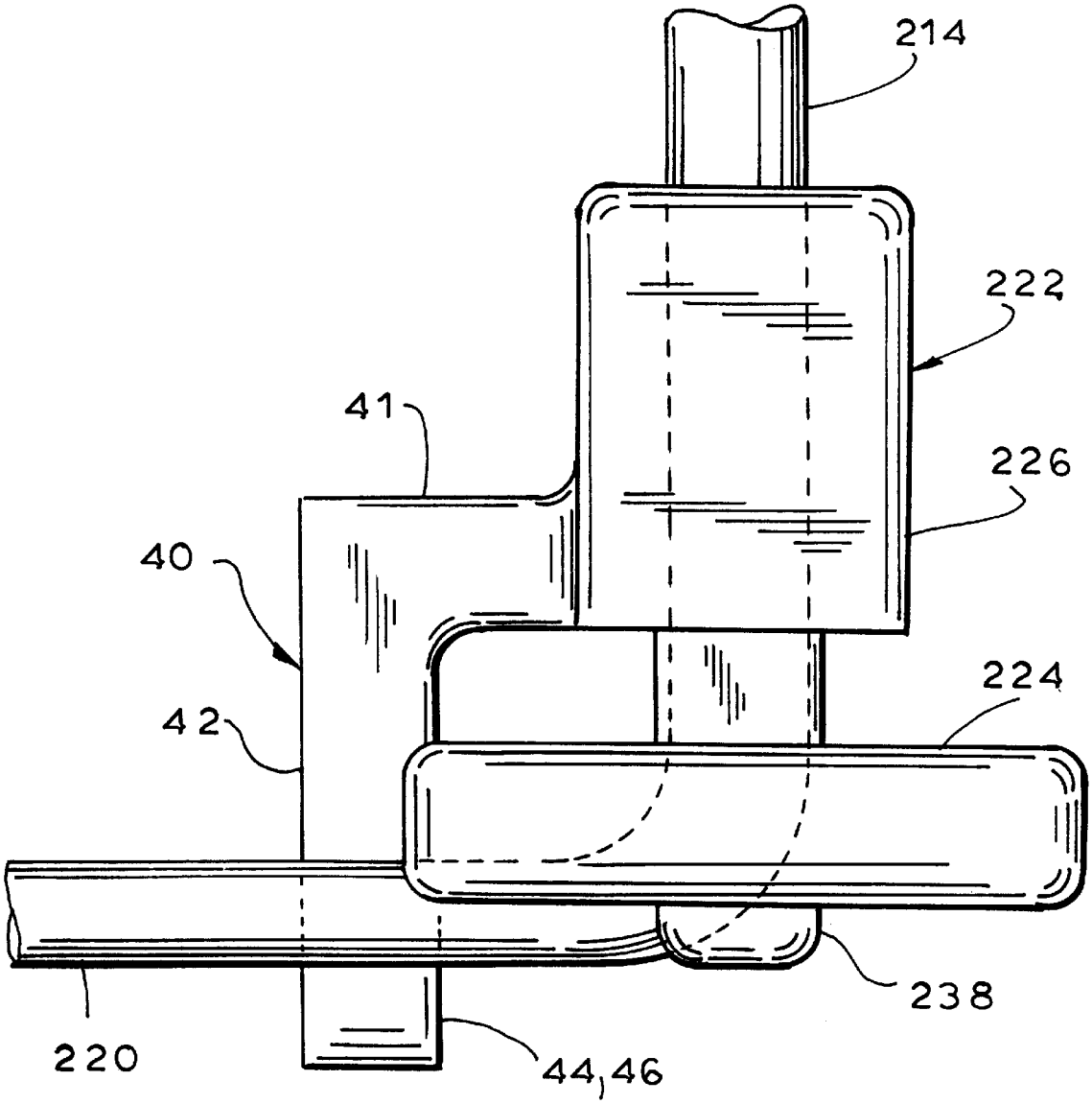
FIGS. 14 and 15 are top plan and front elevational views, respectively of an assembly of the adapter of FIG. 11 mounted on a label holder arm.
Figure 15:
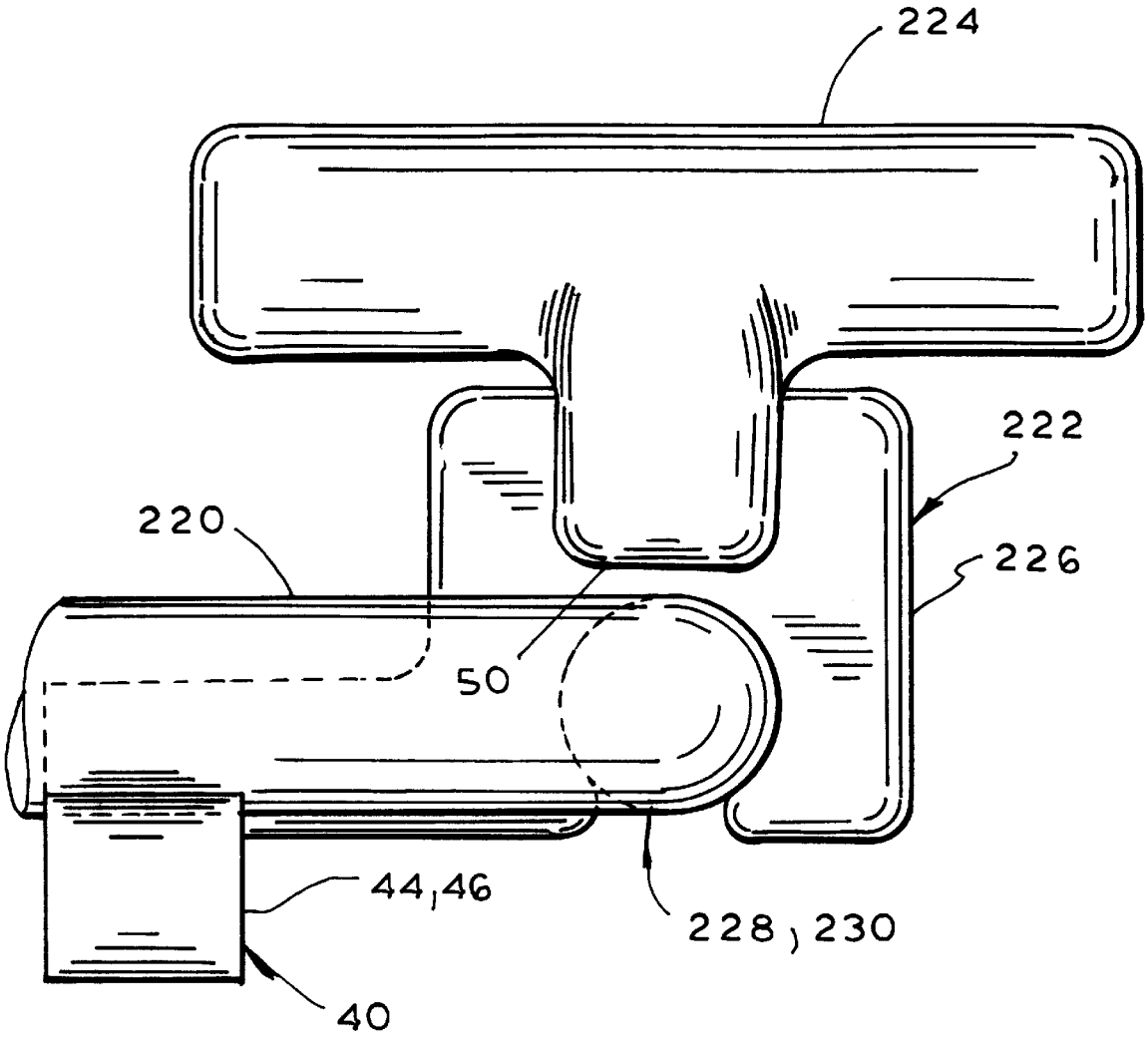

Referring to FIGS. 14 and 15, when the adapter 222 is properly mounted on a label support arm 214, the stabilizing element 40 extends underneath and attaches to the label support portion 220 at a position spaced a predetermined distance laterally from the shaft of the label support arm 214. The label support portion 220 rests in the recess 48 of the stabilizing element 40. Thus, when the adapter 222 and stabilizing element 40 are properly mounted, the element 40 positively locates the adapter along the axis of the label support arm 214 and prevents the adapter 222 from rotating in one direction (clockwise in FIG. 15). The bottom surface 50, of the forwardly extending support 238 contacts the top of the label support portion 220 preventing rotation in the opposite direction. The adapter 222, including the body 226, channel 228, entry gap 230, and stabilizing element 40 are preferably integrally formed from resilient thermoplastic, as by injection molding.

The adapter device of the present invention provides a cost-effective and convenient means for converting existing display hooks to mount pivoting label holders on label support arms which are not originally designed to support pivoting label holders. The adapter device, in its various forms provides a simple and effective means to form cross bar portions on both sides of the label support to support a pivoting label holder in a stable and functional manner.

The adapter device of the invention accommodates the easy and economical conversion and modernization of display hooks, originally designed with a laterally extending outer end portion for the mounting and support of a fixed label holder, to permit the mounting of a more desirable pivoting label holder. By removing the original, fixed label holder and installing the new adapter device of the invention, a store can upgrade its existing, installed inventory of display hooks to employ pivoting label holders without having to resort to a costly program of complete replacement and re-installation of the display hooks.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed:

1. A merchandise display hook having a merchandise support arm, a label support arm and means to mount said merchandise support arm and said label support arm on a support structure, said merchandise display hook comprising:

(a) said label support arm being substantially L-shaped and having (i) a substantially cylindrical shaft with inner and outer ends, said inner end of said shaft being adjacent said means to mount said merchandise support arm, and (ii) a laterally-extending portion projecting from said outer end, perpendicular to said shaft; and (b) an adapter mounted on said substantially cylindrical shaft of said label support arm between said inner and outer ends, said adapter including:

(i) a body portion sized and shaped to mount on said shaft of said label support arm, adjacent said outer end thereof, (ii) a cross bar element, said cross bar element aligned substantially perpendicular to said label support arm when said adapter is mounted thereon, and (iii) means to limit the rotation of said adapter about said substantially cylindrical shaft of said label support arm in at least one direction, said rotation limitation means contacting said laterally-extending portion of said label support arm.

2. Merchandise display hook, as in claim 1, wherein said cross bar element extends laterally from one side of said adapter device, and is aligned substantially coaxially with said laterally extending portion of said label support arm to form a support for a pivoting label holder on both sides of said shaft of said label support arm.

3. A merchandise display hook, as in claim 2, wherein said means to prevent rotation about said shaft further comprises means to engage opposite sides of said laterally extending portion of said label support arm to provide rotational stability to said adapter device with respect to said label support arm, in two directions.

4. A merchandise display hook, as in claim 3, wherein (a) said engagement means comprises a retaining element partially surrounding said laterally extending portion, and (b) said retaining element is configured to limit the rotation of said adapter device about said shaft and to limit the movement of said adapter device along a longitudinal axis of said shaft.

5. A merchandise display hook, as in claim 4, wherein (a) said adapter device further comprises means for slidable attachment thereof to the shaft of said label holder arm, (b) said retaining element further comprises two spaced-apart gripping arms extending forwardly from a body portion of said adapter, said gripping arms forming an entry gap configured to resiliently receive said laterally extending portion, and (c) said retaining element and said cross bar portion being configured such that, when said retaining element is engaged with said laterally extending portion, said cross bar portion and said laterally extending portions are substantially coaxial, (d) whereby said adapter device can be properly mounted to said label support arm by engaging said slidable attachment means to said shaft and moving said adapter device until said retaining element engages and partially surrounds said laterally extending portion.

6. A merchandise display hook, as in claim 1, which further comprises (a) a cross bar affixed forwardly of said body portion and aligned substantially perpendicular to the shaft of a label support arm when said adapter device is mounted thereto, (b) said cross bar being configured to rotatably support said pivoting label holder.

7. A merchandise display hook, as in claim 1, wherein said adapter device includes a forwardly projecting portion positioned to engage a pivoting label holder mounted on said cross bar element, for supporting said label holder at a desired viewing angle.

8. A merchandise display hook as in claim 1, wherein:

(a) said body portion further comprises a channel with a narrow entry gap adapted to releasably tightly frictionally engage said shaft of said label support arm, (b) said adapter further comprises a stabilizing element extending from said body portion, and a cross bar fixed forwardly of said body portion and aligned substantially perpendicular to said shaft of said label support arm when said adapter is mounted thereto, said cross bar being configured to rotatably support a pivoting label holder, (c) said stabilizing element being adapted to engage said laterally extending portion of said label holder arm at a point spaced laterally from an axis of said shaft of said label holder arm, (d) said stabilizing element being adapted to prevent the rotation of said adapter about said shaft of said label holder arm in at least a first direction, and (e) said cross bar being connected to said body portion by a forwardly extending support, a bottom portion of said support contacting said laterally extending portion of said label support arm at a position spaced at least slightly laterally from said axis of said shaft to prevent rotation of said adapter about said shaft in a second direction opposite said first direction.

9. A merchandise display hook as in claim 8, wherein said stabilizing element further comprises a recess sized and shaped to receive said laterally extending portion of said label support arm when said adapter is properly mounted thereon, said recess being sized and shaped to positively locate said adapter axially with respect to said axis of said shaft of said label support arm.

10. A merchandise display hook as in claim 8, wherein:

(a) said stabilizing element is resiliently connected to said body of said adapter, (b) said stabilizing element further comprises an end with an inclined guide portion, for resiliently guiding said element around said laterally extending portion of said label holder arm.

11. A merchandise display hook as in claim 10 wherein said adapter, including said body portion, said forwardly extending support, said cross bar, said channel and narrow entry gap, and said stabilizing clip are integrally formed in one piece from resiliently deformable plastic.

12. A merchandise display hook having a merchandise support arm, a label support arm having a shaft with an outer end, having a laterally extending portion, and means to mount said merchandise support arm and said label support arm on a support structure, said merchandise display hook comprising:

(a) said laterally extending portion of said label support arm extending substantially perpendicular to said shaft from said outer end thereof;

(b) an adapter mounted on said label support arm, said adapter including (i) a body portion sized and shaped to slidably mount on said outer end of said label support arm, and (ii) a cross bar element integral with said body portion, (iii) a retaining element sized and shaped to partially surround said laterally extending portion, said retaining element being configured to limit the rotation of said adapter device about said shaft and to limit the movement of said adapter device along a longitudinal axis of said shaft;

(iv) said retaining element having two spaced-apart gripping arms extending forwardly from said body portion of said adapter, said gripping arms forming an entry gap configured to resiliently receive said laterally extending portion; and (v) said retaining element and said cross bar portion being configured such that, when said retaining element is engaged with said laterally extending portion, said cross bar portion and said laterally extending portions are substantially coaxial, (c) whereby said adapter device can be properly mounted to said label support arm by engaging said body portion to said shaft and slidably moving said adapter device along said shaft until said retaining element engages and partially surrounds said laterally extending portion.

13. A merchandise display hook having a merchandise support arm, a label support arm with a shaft, a laterally extending portion, and means to mount said merchandise support arm and said label support arm on a support structure, said merchandise display hook comprising:

(a) and adapter with a body portion and a cross bar element, (b) said cross bar element being aligned substantially perpendicular to said label support arm and being configured to rotatably support a pivoting label holder (c) said body portion having a channel with a narrow entry gap releasably tightly frictionally engaging said shaft of said label support arm, (d) said adapter further having a stabilizing element extending from said body portion, said stabilizing element engaging said laterally extending portion of said label holder arm at a point spaced laterally from an axis of said shaft of said label holder arm to limit the rotation of said adapter about said shaft of said label holder arm in at least a first direction, and (e) said cross bar being connected to said body portion by a forwardly extending support, a bottom portion of said support contacting said laterally extending portion of said label support arm at a position spaced at least slightly laterally from said axis of said shaft to limit rotation of said adapter about said shaft in a second direction opposite said first direction.

14. A merchandise display hook as in claim 13, wherein said stabilizing element further comprises a recess sized and shaped to receive said laterally extending portion of said label support arm when said adapter is properly mounted thereon, said recess being configured to positively locate said adapter axially with respect to said axis of said shaft of said label support arm.

15. A merchandise display hook as in claim 13, wherein:

(a) said stabilizing element is resiliently connected to said body of said adapter, (b) said stabilizing element further comprises an end with an inclined guide portion, for resiliently guiding said element around said laterally extending portion of said label holder arm.

16. An adapter as in claim 15 wherein said adapter, including said body portion, said forwardly extending support, said cross bar, said channel and narrow entry gap, and said stabilizing element are integrally formed in one piece from resiliently deformable plastic.

* * * * *